United States Patent [19]

George et al.

[11] Patent Number: 4,862,964

[45] Date of Patent: Sep. 5, 1989

[54] METHOD AND APPARATUS FOR PERFORATING WELL BORES USING DIFFERENTIAL PRESSURE

[75] Inventors: Flint R. George, Katy; Kevin R. George, Columbus, both of Tex.

[73] Assignee: Halliburton Company, Duncan, Okla.

[21] Appl. No.: 314,329

[22] Filed: Feb. 21, 1989

Related U.S. Application Data

[63] Continuation of Ser. No. 40,218, Apr. 20, 1987, abandoned.

[51] Int. Cl.[4] ..... E21B 43/117

[52] U.S. Cl. ..... 166/297; 166/55.1; 175/4.52; 175/4.54

[58] Field of Search ..... 166/297, 55.1, 250; 175/4.52, 4.54, 4.56

[56] References Cited

U.S. PATENT DOCUMENTS

| | | | |
|---|---|---|---|
| 4,499,951 | 2/1985 | Vann | 166/297 |
| 4,515,217 | 5/1985 | Stout | 166/297 |
| 4,544,034 | 10/1985 | George | 175/4.52 X |
| 4,616,718 | 10/1986 | Gamberfoglio | 166/297 X |

*Primary Examiner*—Hoang C. Dang

*Attorney, Agent, or Firm*—Arnold, White & Durkee

[57] ABSTRACT

A method and apparatus for perforating oil well casing in a well bore, with particular advantage in highly deviated well bores. The perforating guns are run into the well bore using the production tubing. A sliding sleeve is connected in the tubing above the guns and a packer is run in for setting above the sliding sleeve and guns. The assembly is run into the well bore until the guns extend into the highly deviated portion of the bore where the well casing is to be perforated. The packer is set into place, isolating that portion of the well bore below the packer from that portion above the packer, and the sliding sleeve is opened using a wireline or other means. The well bore below the packer is pressurized through the tubing to ensure that the packer is properly set. The pressure is then allowed to bleed off and the sliding sleeve is closed. The guns use a differential pressure-actuated firing head which is actuated upon a predetermined differential pressure between the production tubing bore and the annulus between the tubing and the casing. The invention provides the capability of perforating well casing using relatively low values of actuating pressure, providing greater control over performating conditions such as underbalance.

14 Claims, 4 Drawing Sheets

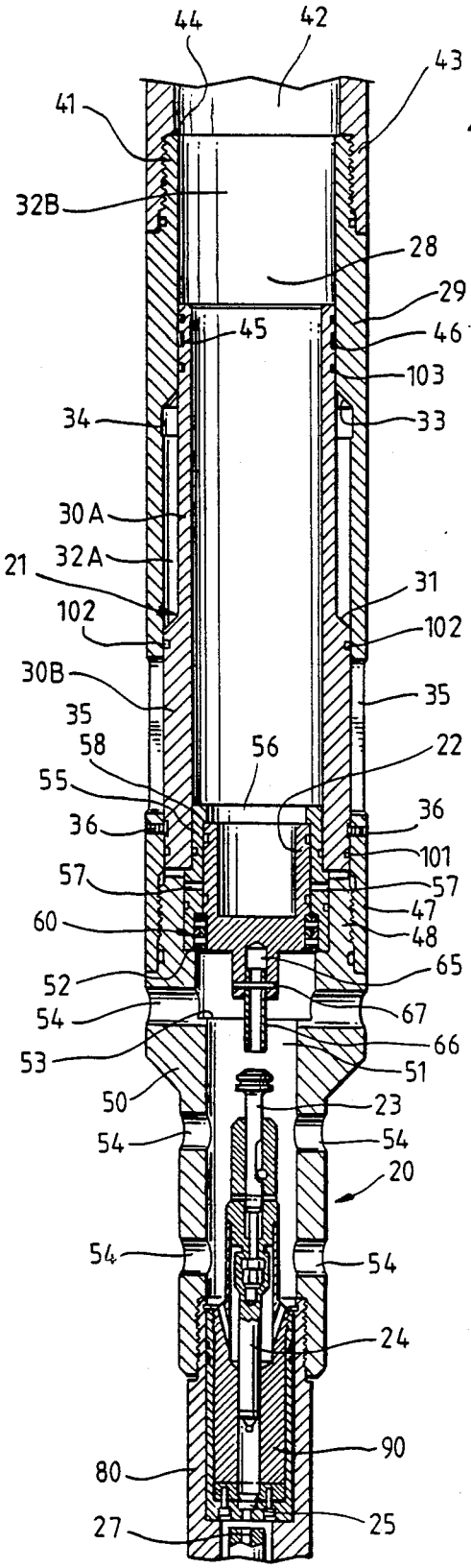
Fig. 2A
Fig. 2B
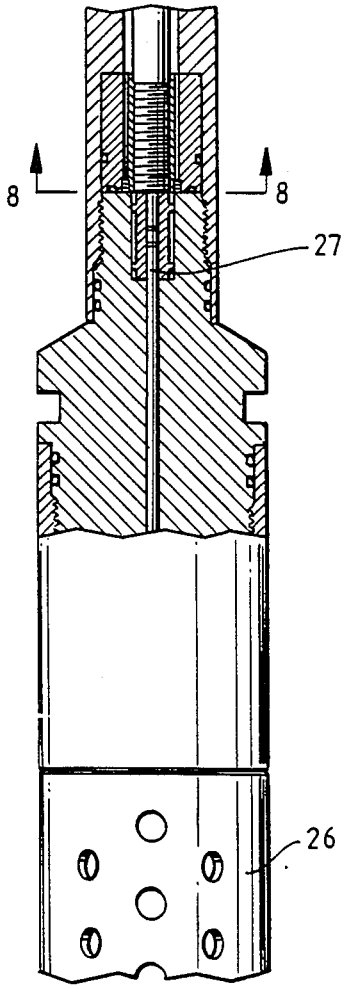

Fig. 3
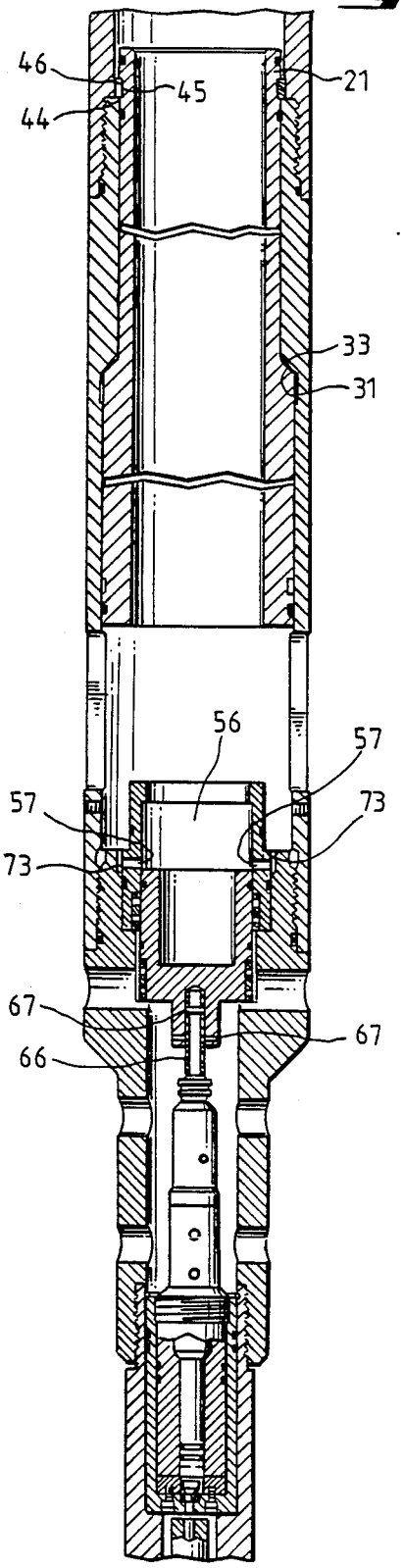
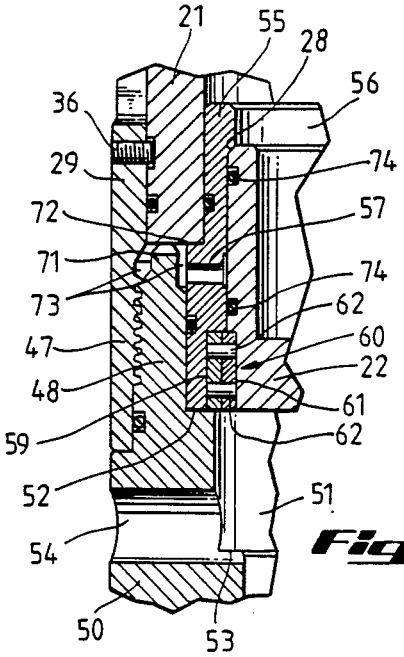
Fig. 2C
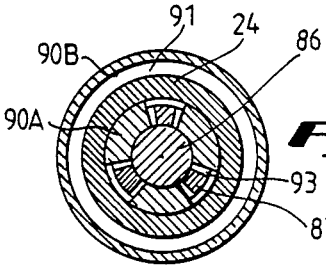
Fig. 7
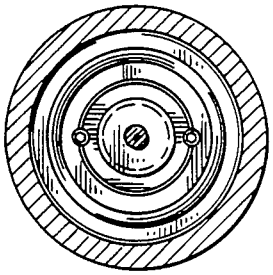
Fig. 8

METHOD AND APPARATUS FOR PERFORATING WELL BORES USING DIFFERENTIAL PRESSURE

This is a continuation of co-pending application Ser. No. 07/040,218 filed on Apr. 20, 1987 now abandoned.

FIELD OF THE INVENTION

The present invention relates to the perforation of casing in well bores with tubing conveyed perforating guns and, more particularly, to perforation of casing in wells with tubing conveyed perforating guns through use of reduced pressures. The methods and apparatus of the present invention are particularly advantageous in highly deviated well bores and well bores having restricted access to the perforating gun firing head.

BACKGROUND OF THE INVENTION

Well casing perforation technology has developed over a number of years into a rather sophisticated art. Tubing conveyed perforating guns, which are common today, are lowered into a well bore which has been lined with a casing until they are in the area of the bore adjacent the geological zone containing desired oil or gas. A firing head is used with the guns to cause charges in the guns to explode. The explosions result in holes in the casing, allowing the gas or oil in the formation to flow into the casing. A tubing string extending through the casing bore is used to flow the oil or gas to the surface of the earth.

With tubing conveyed perforating, two types of firing heads have become most popular for detonating the perforating gun charges. The first type is a mechanically-actuated device that is actuated by a rod which is dropped down the tubing string from the surface. The rod strikes a "plunger" which, in turn, strikes an initiator, causing the charges to explode. The second type is a pressure-actuated head wherein fluid or gaseous pressure is applied to the tubing string bore. The pressure is transmitted to the firing head "plunger" which is held in place by shear pins. When the pressure reaches a predetermined level, the pins are sheared and the plunger is forced against the initiator. The charges are thus caused to explode.

Each of these popular techniques has its drawbacks. The rod is susceptible to hanging up in the tubing string and special provisions are required to ensure a clear, straight path to the firing head. The pressure-actuated devices are not particularly well suited for applications where a large underbalance condition is desired or where the formation pressure is low and an underbalanced condition is desired or required. These heads typically require pressures in the range of 4000 psi or greater for actuation, severely limiting the ability to maintain an underbalanced condition for perforation.

Highly deviated wells present additional problems. In many applications, a well bore may deviate from the vertical by as much as 80° and this nearly horizontal deviation may extend for several thousand feet. In a well such as that, the sliding rod actuated firing head is not useable. The pressure-actuated firing head has been used and its disadvantages have been tolerated.

SUMMARY OF THE INVENTION

The method and apparatus of the present invention provide a one-trip technique for running the perforating gun and packer into a well bore, for example a highly deviated bore, setting the packer and pressure-testing its seal, creating the desired underbalance conditions, and perforating the well casing. The perforating gun firing head is actuated when a pre-selected differential pressure between the tubing bore and the well bore lower annulus is reached. This pressure differential can be as low as 1000 to 2000 psi, enabling improved control over perforating conditions.

The perforating assembly includes a gun and associated firing head, a sleeve valve connected in the tubing which can be opened to provide fluid communication between the tubing bore and the well bore annulus, and a packer for isolating the annulus of the lower portion of the well bore from the annulus of the remainder of the well bore. The assembly is run into the well bore, normally with the sleeve valve open, until the perforating gun is situated adjacent the desired production zone. In many applications, this zone will be in a highly deviated portion of the bore. The packer is set in place and, if the sleeve valve is not open, a wireline or other means is used to open the valve. The lower annulus is pressurized through the tubing bore and sleeve valve to test the seal of the packer. After testing, the pressure is allowed to bleed off or is pumped off until the desired level of underbalance is achieved. The sleeve valve is then closed and actuating pressure is applied to the production tubing bore. The firing head on the perforating gun is exposed to the pressure and, when a pre-determined differential of pressure between the tubing bore and the lower annulus is reached, the firing head is actuated.

The firing head has associated with it a sliding cylindrical sleeve which slides upward when the head is actuated. When the sleeve moves upward, production ports in the sides of the head assembly are opened, providing fluid communication between the lower annulus of the well bore and the interior of the tubing string. This fluid communication results in a sudden decrease in the firing head actuating pressure, which can be sensed at the earth's surface, and it allows the production of the oil or gas from the lower annulus upward through the tubing string.

BRIEF DESCRIPTION OF THE DRAWINGS

FIGS. 2A and 2B are a sectional view of a firing head assembly according to the present invention.

FIG. 2C is an enlarged section of a part of the firing head assembly of FIGS. 2A and 2B.

FIG. 3 is a sectional view of the firing head assembly of FIGS. 2A and 2B in the actuated position.

FIG. 7 is a cross-sectional view taken as shown in FIG. 5.

FIG. 8 is a cross-sectional view taken as shown in FIG. 2B.

DETAILED DESCRIPTION OF THE PREFERRED EMBODIMENT

Figures 1, 4:
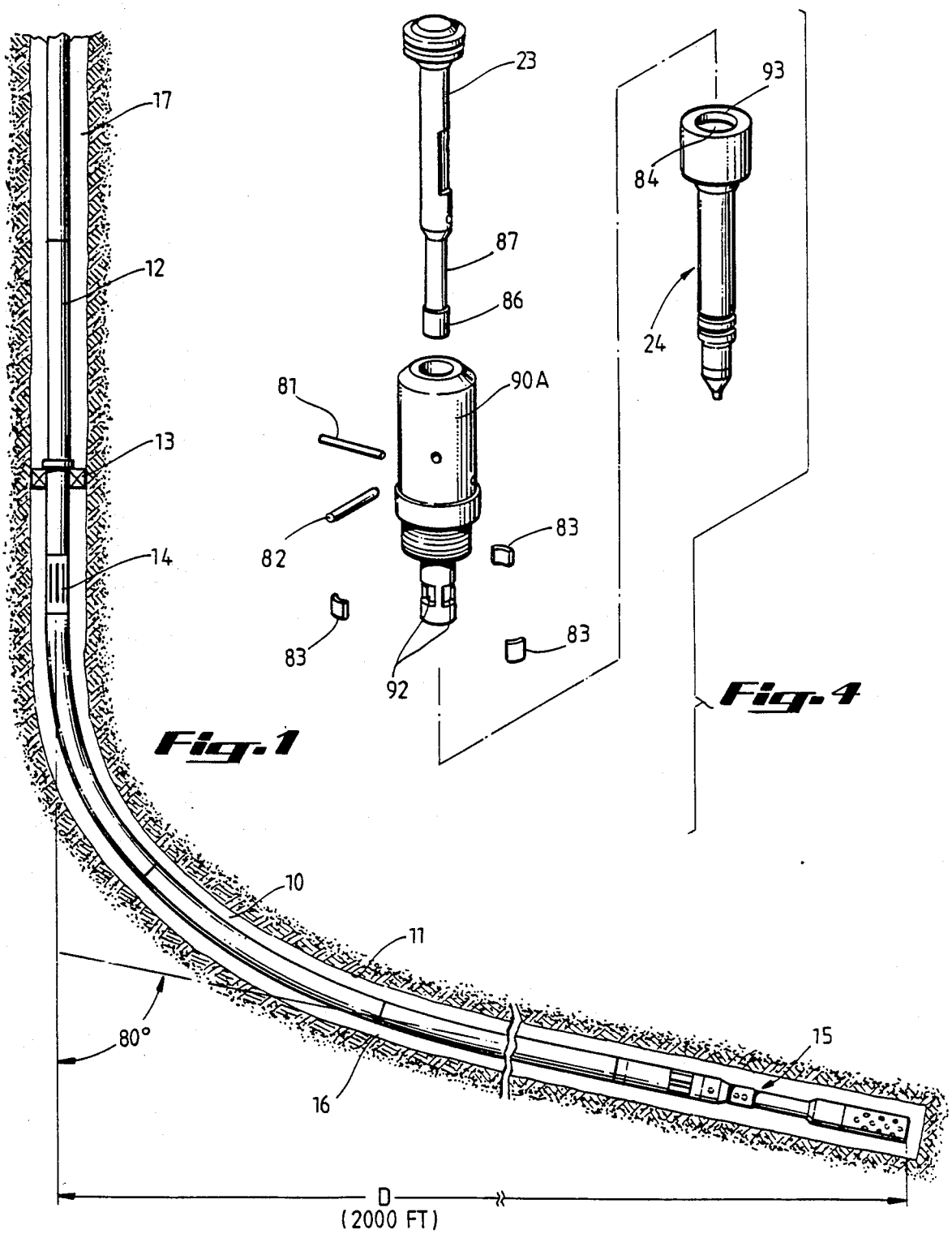
FIG. 1 is an elevation showing a highly deviated well bore having a production tubing string, packer, sleeve valve and perforating gun assembly therein.
FIG. 4 is an exploded view of the firing head assembly of FIGS. 2A and 2B.

FIG. 1 shows a highly deviated well bore 10 in which the method and apparatus of the present invention might be advantageously employed. The bore 10 may deviate from the vertical typically by as much as 80° and may extend at that angle for 2000 feet or more. The bore 10 is lined with a well casing 11 which will be perforated in the vicinity of the production zone.

Extending along the well bore 10 is a production tubing string 12 having a packer 13, a sleeve valve 14 and a perforating gun assembly 15 mounted thereon. The packer 13, sleeve valve 14 and perforating gun assembly 15 are connected to the production tubing string 12 as the string 12 is run into the well bore 10. The gun assembly 15 is run into the bore 10 until it is adjacent the desired geological production zone.

When the gun assembly 15 is properly positioned in the well bore 10, the packer 13, which may be of a well known type, is set in place. The packer 13 provides a seal between the lower bore annulus 16 and the upper bore annulus 17 and its operation is known and understood by those of skill in the art. The sleeve valve 14 is also of a well known type and may be opened and closed using a wireline or other means. When open, the valve 14 allows fluid communication between the bore of the tubing string 12 and the lower annulus 16 and, when closed, that communication is prevented.

When the production string 12 and perforating assembly are run into the well bore 10, the sleeve valve 14 is normally in its open position. If a hydraulically-set packer 13 is used, a check valve is lowered into the tubing string 12 and is positioned in the tubing bore below the packer 13 and above the sleeve valve 14. The tubing bore is then pressurized to set the packer 13 in place and the check valve is removed. A mechanically-set packer 13 would not require the use of such a check valve for setting in place.

Once the packer 13 has been set in place, its seal is pressure-tested. A wireline or other means is used to open the sleeve valve 14 if it is not already open and fluid or gaseous pressure is introduced to the bore of the tubing string 12 at the earth's surface. The fluid or gas is transmitted through the tubing string 12 and out the sleeve valve 14. The pressure in the tubing string 12 and the pressure in the lower annulus 16 are equal and, for reasons which will be more fully discussed below, the perforating gun 15 will not discharge under those conditions. The pressure is increased until the desired test level has been reached.

After testing the packer, the pressure will be allowed to "bleed off" or it may be pumped off. The extent to which the pressure will be allowed to subside will be determined by the desired perforating conditions. For example, if it is desired to perforate the well casing 11 having a selected underbalance, the pressure in the lower annulus 16 (and thus the tubing string 12) will be lowered until that underbalanced condition is achieved. (This is determined by knowing the formation pressure.) When the desired pressure is achieved in the lower annulus 16, the wireline or other means is used to close the sleeve valve 14, preventing further fluid communication between the tubing string 12 and the lower annulus 16.

FIGS. 2A and 2B, together, show a section view of a firing head assembly 20 which may be used in the perforating gun assembly 15 of FIG. 1. The firing head assembly 20 is shown in its unactuated position and it includes a sliding sleeve 21, a differential pressure actuated piston 22, a firing rod 23, an initiator rod 24, an initiator 25, and a perforating gun 26. The assembly 20 may also include a delay mechanism 27 for delayed firing of the gun after actuation of the firing head. A delay mechanism which may be used is known as Vann Systems' type TDF device. Other pyrotechnic delay devices known to those in the art may also be used.

Referring to FIG. 2A, the sliding sleeve 21 is a cylinder which is contained within the bore 28 of a housing 29. The sleeve 21 has an upper portion 30A having a reduced outside diameter terminating in an external annular shoulder 31. The outside diameter of the upper portion 30A is approximately equal to the diameter of the bore 28 and is slideable therein. The bore 28 of the housing 29 has a lower portion 32A which has a diameter greater than its upper portion 32B and which is adapted to slidingly receive the lower portion 30B of the sleeve 21. The bore 28 has an internal annular shoulder 33 which is adapted to abut the external annular shoulder 31 of the sleeve 21 when the sleeve 21 is in its upwardmost, or open, position. This can most easily be seen by reference to FIG. 3. Adjacent the shoulder 33 and located in the lower portion 32A of the bore 28 is a groove 34 whose diameter is greater than the diameter of the lower portion 32A. The function of the groove 34 will be explained below.

Continuing to refer to FIG. 2A, production ports 35 are located in the lower portion of the housing 29. The size of the ports 35 will typically be such that the total cross-sectional area of the ports 35 will equal or exceed the cross-sectional area of the bore 28, thus providing maximum flow capability through the ports 35 as will be seen more clearly below. When the sliding sleeve 21 is in its downwardmost, or closed, position, its lower portion 30B blocks the ports 35. The sleeve 21, thus, alternatively blocks the production ports 35 when it is in its downward or closed position and opens the ports 35 when it is in its upward or open position. Annular seals 101, 102 and 103 are retained in grooves about the circumference of the sleeve 21 and provide a fluid seal when the sleeve 21 is in its closed position.

The housing 29 has a pin, or male, threaded connection 41 at its upper end which is adapted to threadedly engage a box, or female, connection 43 on the tubing string 12. The upper portion 32B of the bore 28 of the housing 29 has a diameter less than the diameter of the bore 42 of the mating box connector 43 so that when the housing pin connector 41 is threaded into the box connector 43, an internal shoulder 44 results at the interface between bore 28 and bore 42. The upper portion 30A of the sleeve 21 has an external annular groove 45 in which is positioned a snap ring 46.

When the sleeve 21 is in its closed position, the snap ring 46 is completely retained within the groove 45 because of the diameter of the bore 28. However, when the sleeve 21 moves upward to its open position, the groove 45 and ring 46 are extended into the enlarged bore 42. The ring 46 springs outwardly such that, while being partially retained within the groove 45, its outer diameter is limited by the diameter of the bore 42. Because the ring 46 has expanded, the sleeve 21 is prevented from resuming its closed position because the ring 46 will engage the shoulder 44 and the groove 45. This is easily seen by reference to FIG. 3.

The housing 29 has a box, or female, connector 47 at its lower end for receiving a pin connector 48 of a piston housing 50. The piston housing 50 has a longitudinal bore 51 having two internal annular shoulders 52 and 53 which are longitudinally spaced. The bore 51 lies along the axis of the bore 28 of the housing 29 and is in communication therewith when the housing 29 and the piston housing 50 are connected. Radial bores 54 are located in the housing 50 and interconnect the bore 51 with the exterior of the housing 50. A cylinder 55 having a piston bore 56 is threadedly positioned within the upper end of the piston housing 50 and abuts the shoulder 52. Radial bores 57 are located in the cylinder 55.

The piston 22 slides within the piston bore 56 of the cylinder 55 and is limited in its upward movement by a shoulder 58 in the piston bore 56. The piston 22 is retained within the bore 56 by a shear pin set 60.

Referring to FIG. 2C, an annular recess 59 in the bore 56 is situated opposite an annular groove 61 in the piston 22 when the piston 22 is in its uppermost position in the bore 56. The shear pin set 60 is located in the annulus formed between the recess 59 and the groove 61 and is retained in place by the shoulder 52. The shear pin set 60 includes shear pins 62 which are designed to shear at a predetermined value. The determination of that value and the function of the shear pin set 60 will be discussed more fully below.

Referring again to FIG. 2A, the piston 22 includes a bore 65 in its lower end. The bore 65 receives an actuator rod 66 which protrudes from the bore 65 and which is held in a partially-inserted position by a shear pin 67. As will become clear from the discussion below, the actuator rod 66 and shear pin 67 cooperate to absorb some of the impact between the piston and the firing rod 23 when the firing head assembly 20 is actuated.

Referring to FIGS. 2A and 2C, the end 71 of the pin connector 48 of the piston housing 50 is configured to abut the end 72 of the sliding sleeve 21 when the piston housing 50 and housing 29 are joined. A chamber 73 is formed about the end 71 of the pin connector 48 and is connected with the radial bores 57 in the cylinder 55. When the piston 22 is in its fully inserted position in the piston bore 56, being held in place by the shear pin set 60 in cooperation with the shoulder 52, the radial bores 57 are blocked by the piston 22. Annular seals 74 about the circumference of the piston 22 ensure that the piston bore 56 is not in fluid communication with the radial bores 57. Under conditions which will be described below, the shear pins 62 in the shear pin set 60 will yield and the piston 22 will be urged out of the piston bore 56. By reference to FIG. 2, it can be seen that when the piston 22 is in this actuated position, the radial bores 57 provide fluid communication between the piston bore 56 and the chamber 73.

Figure 5:
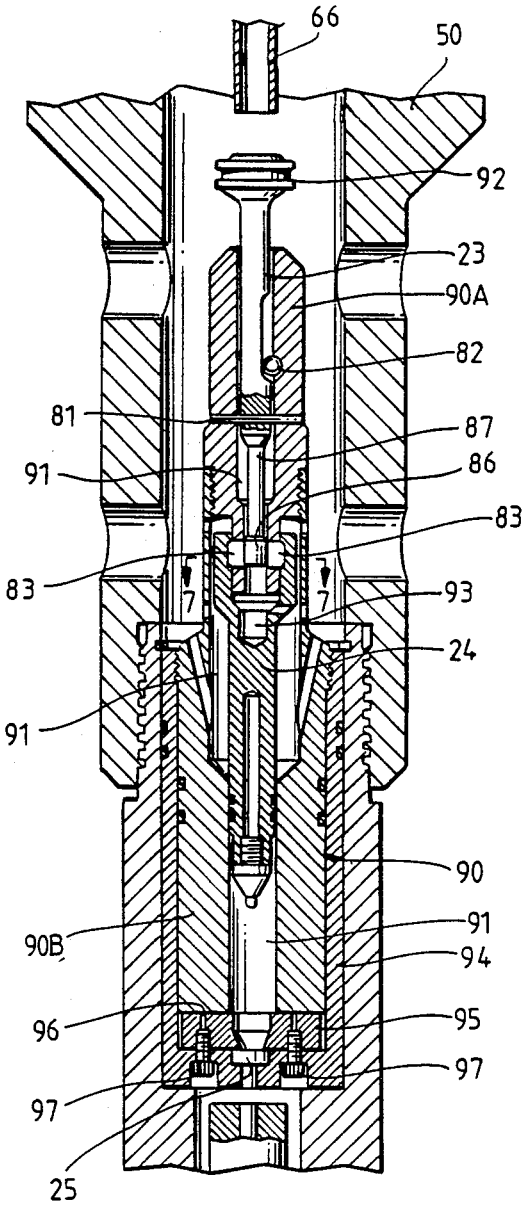
FIG. 5 is an enlarged sectional of the firing head assembly of FIGS. 2A and 2B in its unactuated position.
Figure 6:
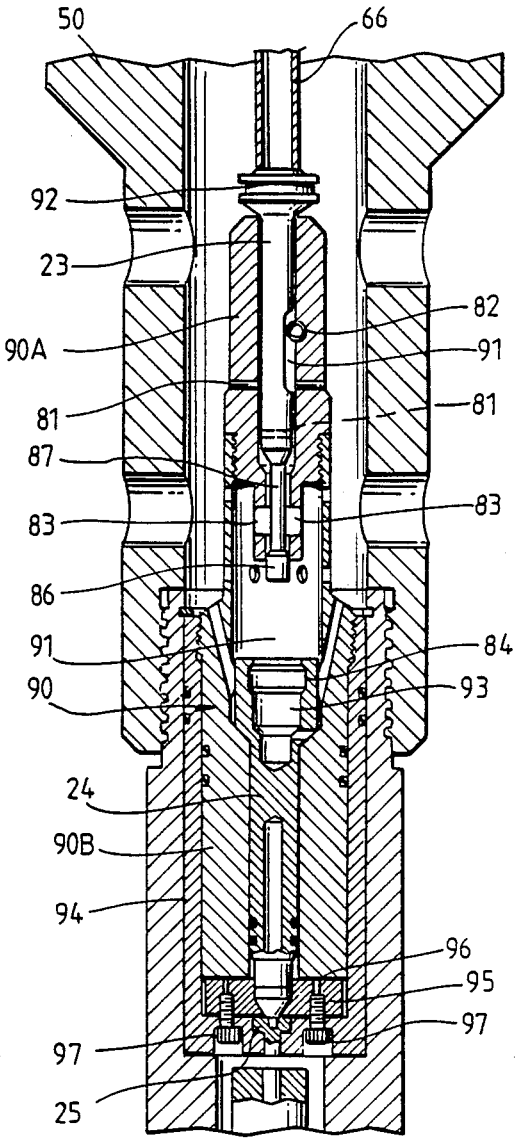
FIG. 6 is an enlarged sectional of the firing head assembly of FIGS. 2A and 2B in its actuated position.

The firing head assembly 15 is of a known design and typically includes a firing rod 23, an initiator rod 24 and an inititator 25, all contained in a firing head housing 90. One such firing head assembly is commonly known as Vann Systems' Model IID. An exploded view of the major components of such an assembly is shown in FIG. 4. FIGS. 5 and 6 show enlarged sectional views of a typical assembly 15.

Referring to FIGS. 4, 5 and 6, the housing 90, which may be of two portions 90A and 90B, is cylindrical and has a longitudinal bore 91 of varying diameter therethrough. The firing rod 23 extends into the bore 91 of the housing portion 90A and has a head 92 on its exterior end. The rod 23 is normally held in a partially-inserted position by a shear pin 81 which engages the housing 90A and the rod 23. A retainer pin 82 engages the housing portion 90A and a slot in the rod 23. The pin 82 prevents rotation of the rod 23 in the bore 91 and retains the rod 23 in the bore 91 at all times. Toward its interior end, the rod 23 has a narrowed diameter 87 and terminates in an enlarged lower end 86.

As can be seen in FIG. 4, the lower end of the housing portion 90A includes slots 92 for lock segments 83. When assembled, the enlarged lower end 86 of the rod 23 is adjacent the slots 92 in the housing portion 90A. The lock segments 83 fit within the slots 92 and are biased inwardly. The enlarged lower end 86 of the rod 23 limits the inward travel of the segments 83 such that the segments 83 protrude from the slots 92. A snap ring or C-ring may be used in place of the lock segments 83.

The initiator rod 24 is generally cylindrical, having a retainer bore 93 at one end which is about the same diameter as the lower portion of the housing 90A. An annular groove 84 is located about the circumference of the retainer bore 93 and is adapted to receive the lock segments 83 (or, alternatively, a snap ring) when assembled. The retainer bore 93 is adapted to receive the lower portion of the housing portion 90A and, because the spring segments 83 protrude from the slots 92 and engage the groove 84 in the bore 93, the initiator rod 24 is captured and held in place by the housing portion 90A.

The bore 91 in the lower portion 90B of the housing 90 is adapted to receive the initiator rod 24 when the housing portions 90A and 90B are assembled. The assembled housing 90 is inserted into a sleeve 94 which is adapted to hold an initiator 25 in one end. A spacer 95 may be positioned between the end of the housing 90 and the end of the bore of the sleeve 94, as can be clearly seen in FIGS. 5 and 6. As the housing 90 is assembled into the sleeve 94, pneumatic pressure can prevent complete insertion. For that reason, passages 96 are provided on the sleeve end to allow the trapped air to escape. After complete assembly, the passages are closed using counter-sunk screws 97.

A commonly known delay device such as Vann Systems' type TDF may be used to delay the firing of the perforating gun after actuation of the firing head assembly. Use of similar delay devices and the use of perforating guns with the present invention will be obvious to those of skill in the art.

OPERATION OF THE PREFERRED EMBODIMENT

The perforation of a well bore using the apparatus of the present invention results in greater control over the downhole conditions at the moment of perforation. A highly deviated well bore such as is illustrated in FIG. 1 is drilled at the desired angle for the desired distance. After lining the well bore 10 with casing 11, the perforating gun assembly 15, including a differential pressure actuated firing head and a perforating gun, is attached to the production tubing string 12 as described above and is started into the cased bore. At a selected distance above the gun assembly 15, the sleeve valve 14 is connected into the tubing string 12 and, typically just above the valve 14, the packer 13 is connected in the string 12.

The tubing string 12 is run into the cased bore until the gun assembly 15 reaches a point adjacent the desired production zone. In a deviated bore such as shown in FIG. 1, that point normally lies in the highly deviated portion of the bore. The valve 14 and packer 13 normally are spaced sufficiently apart from the gun assembly 15 so as to be positioned in the generally vertical portion of the bore.

When the gun assembly 15 has been properly located, the packer 13 is set in place. If the sleeve valve is not already open, a wireline or other means is used to open the valve 14 and fluid or gaseous pressure is applied to the annulus of the bore below the packer 13 by way of the tubing string 12 and sleeve valve 14. This pressure is applied to test the seal of the packer 13 and in many applications will not exceed 3500 pounds. The setting and pressure-testing of the packer 13 are known and understood by those of skill in the art. The structure and operation of a sleeve valve 14 is also known and understood by those of skill in the art.

During the pressure-testing of the packer seal, the differential pressure-actuated firing head is not subject to firing pressure. Referring to FIGS. 1 and 2A, the pressure inside the tubing string 12 is equal to the pressure in the well bore annulus because of the open sleeve valve 14. The radial bores 54 in the piston housing 50 provide fluid communication between the well bore annulus and the bore 51 in the piston housing 50. This pressure is exerted on the lower face of the piston 22, urging it upward into the piston bore 56 of the cylinder 55. An equal pressure is applied to the upper face of the piston 22 through the tubing string bore 42 and the bore 28 of the housing 29, urging the piston downward. Because of the equal pressures, no pressure differential exists to actuate the piston 22 and the firing head.

After testing the packer seal, the pressure is allowed to "bleed off", thus lowering the pressure in the annulus of that portion of the wall bore 10 below the packer 13. When the pressure has reached an acceptable level, the sleeve valve 14 is closed, blocking further fluid communication between the lower annulus and the production tubing string 12. The firing head assembly is then ready to be actuated.

Fluid or gaseous pressure is applied to the tubing string bore 42 and is transmitted to the piston 22 of the firing head assembly 20 by way of the bore 28 of the housing 29. The sliding sleeve 21 is in its fully closed, or lowered, position and is held in this position by the shear screws 36. In its closed position, the sleeve 21 blocks the production ports 35 in the housing 29 and there is no fluid communication between the bore 28 and the well bore lower annulus.

Likewise, prior to actuation, the piston 22 is fully retracted into the piston bore 56 of the cylinder 55 and is held in place by the shear pin set 60 in cooperation with the shoulder 52. In this retracted position, the piston 22 blocks the radial bores 57 in the cylinder 55.

As the pressure in the tubing string bore 42 is increased, a pressure differential develops between the upper face of the piston 22 and its lower face, urging the piston 22 downward. The pressure on the lower face remains substantially constant and equal to the well bore lower annulus pressure because of the radial bores 54 and the bore 51 in the piston housing 50. The shear pins 62 in the shear pin set 60 will withstand this pressure differential up to their design limits. In determining the yield values of the shear pins 62, many factors are considered, including formation pressure and the degree of underbalance which will be desired at perforation. Typically, the pins 62 will be specified to yield at a pressure value which will be below the level used to pressure-test the seal of the packer 13. This will prevent possible pressure in the lower annulus which is greater than that which the packer 13 may seal.

When the pressure differential across the piston 22 exceeds the yield strength of the shear pins 62, the pins 62 will shear and the piston 22 will be forced into its lower, or extended, position. This action has two results. First, the radial bores 57 become unblocked and provide fluid communication between the piston bore 56 (and, thus, the bore 28) and the chamber 73. This can most easily be seen by reference to FIG. 3. Second, the perforating gun firing sequence is initiated.

The chamber 73, prior to actuation of the piston 22, is at atmospheric pressure, having been assembled at the surface. The sudden presence of relatively high pressure creates an upward thrusting force on the sliding sleeve 21. This force causes the screws 36, which may be made of brass or other appropriate material, to shear and the sleeve 21 is thrust upward. As the sleeve 21 is in an intermediate position between open and close, the seals 101, 102 and 103 lose their sealing relationship and fluid or gas is forced between the lower portion 30B of the sleeve 21 and the lower portion of the housing 29. This will occur when the sleeve 21 has moved sufficiently upward that the lowermost seal 101 is located adjacent the ports 35, the middle seal 102 is located adjacent the enlarged diameter of the groove 34, and the uppermost seal 103 has entered the enlarged diameter of the bore 42. As the sleeve continues upward, the fluid or gas becomes trapped between the annular shoulders 31 and 33. This trapped fluid or gas dampens the impact between the shoulders 31 and 33 as the sliding sleeve 21 is thrust open. When the sleeve 21 is pushed upward, the snap ring 46 expands as it enters the enlarged bore 42 of the production tubing. Although the sleeve 21 may then fall back a short distance, it is prevented from falling back to its closed position as the ring 46 is captured by the annular groove 45 of the sleeve 21 and the shoulder 44 on the end face of the pin connector 41. In FIG. 3, the sleeve 21 is shown broken so that the seals 101 and 103 and ring 46 are shown in their final positions while the seal 102 and shoulders 31 and 33 are illustrated in the positions assumed at extreme upward travel of the sleeve 21.

With the sleeve 21 in its open position, the production ports 35 in the housing 29 are open and the actuating pressure in the tubing string bore 42 escapes into the well bore lower annulus. This decrease of pressure in the tubing string bore 42 may easily be detected at the earth's surface with appropriate monitoring equipment, and will indicate actuation of the firing head piston 22. If a time delay device is used with the perforating gun, this delay may be used to monitor the lower annulus pressure and change that pressure as desired.

The second result of the movement of the piston 22 to its lower, or extended, position in response to the pressure differential is the initiation of the firing of the perforating gun. As shown in FIGS. 3 and 6, the actuator rod 66 strikes the firing rod 23, forcing it down. The impact between the actuator rod 66 and the firing rod 23 is dampened by the yielding of the shear pin 67. The pin 67 will normally have a relatively low shear strength to dampen the impact and yet ensure operation of the firing rod 23. When the pin 67 is sheared, the rod 66 is pushed into the bore 65 in the piston 22. Maximum travel of the piston 22 may be limited by the length of the actuator rod 66 or the relative location of the shoulder 53.

Referring to FIGS. 4 and 5, prior to operation of the piston 22, the firing rod 23 is held in place by the shear pin 81. The enlarged lower end 86 of the firing rod 23 holds the lock segments 83 outward so as to engage the groove 84 in the initiator rod 24. When the piston 22 is actuated and the rod 66 strikes the firing rod 23, the pin 81 is sheared and the rod 23 is forced downward. The enlarged lower end 86 of the firing rod 23 disengages the lock segments 83 and a narrowed diameter 87 of the rod 23 allows the segments 83, which are biased inward, to spring inward, disengaging the groove 84 in the initiator rod 24. The initiator rod is then forced downward to impact the initiator 25. The initiator 25 may be used to cause immediate or delayed firing of the perforating gun 26. The firing head assembly 20 in its actuated state is shown in FIG. 6.

Upon perforation of the well casing 11 (see FIG. 1), the oil or gas from the formation will be forced into the well bore 10 by the formation pressure. The product will flow through the production ports 35, into the tubing string bore 42, and up to the earth's surface.

Although one specific embodiment of the method and apparatus of the present invention has been shown and described, other embodiments will be obvious or may be developed. The scope of the present invention should, accordingly, be limited only by the appended claims.

What is claimed is:

1. A method for perforating a well casing in a well bore, comprising the steps of:

running a perforating gun, a firing head, a valve and a packer into the well casing on a production tubing string having a bore therethrough;

setting the packer to divide the well bore into an upper annulus and a lower annulus, the upper and lower annuli being formed between the tubing and the well casing;

opening the valve to provide fluid communication between the tubing string bore and the lower annulus;

applying fluid pressure, after setting the packer, to the lower annulus of the well bore by applying pressure to the tubing string bore and through the valve to test the packer setting;

reducing the fluid pressure in the lower annulus of the well bore;

closing the valve to provide isolation between the tubing string bore and the lower annulus;

creating a predetermined pressure differential between the tubing string bore and the lower annulus of the well bore;

applying the pressure differential to a movable piston in the firing head to cause the piston to initiate firing of the gun to perforate the well casing; and applying tubing bore pressure to a sliding sleeve to open a production port to provide fluid communication between the lower annulus and the tubing bore.

2. A method for perforating a well casing in a well bore, comprising the steps of:

running a perforating gun, a firing head, a valve and a packer into the well casing on a production tubing string having a tubing bore therethrough;

setting the packer to divide the well bore into an upper annulus and a lower annulus, the upper and lower annuli being formed between the tubing and the well casing;

creating a pressure differential between the tubing string bore and the lower annulus;

applying the pressure differential to a movable piston in the firing head, causing the piston to initiate firing of the gun and opening a sleeve-actuating port to provide fluid communication between the tubing bore and a sliding sleeve; and applying tubing bore pressure through the sleeve-actuating port to the sliding sleeve to open a production port to provide fluid communication between the lower annulus and the tubing bore.

3. The method of claim 2, comprising the further step of delaying the firing of the perforating gun for a predetermined time interval after the production port opens.

4. The method of claim 2, wherein the pressure differential between the tubing string bore and the lower annulus decreases when the production port opens.

5. The method of claim 4, comprising the further step of sensing a pressure drop in the tubing string bore after the production port opens.

6. A well bore perforating apparatus, comprising:

a tubing for insertion into a well bore, forming an annulus in the well bore, the tubing having a longitudinal bore therethrough;

a packer attached to the tubing and intermediate its ends for dividing the annulus into an upper annulus and a lower annulus;

a perforating gun assembly connected to the tubing in the lower annulus, the assembly including a firing head, a piston, a production sleeve and a production port, the piston and sleeve being independently slidable in the assembly, the piston being slidable in the assembly between a first, unactuated position to a second, actuated position in response to a predetermined difference of pressure between the tubing bore and the lower annulus, the piston being operative, when in its second position, to actuate the firing head, and means for allowing, pressure in the tubing bore to move the sleeve from a first position wherein the production port is blocked to a second position wherein the production port is open to provide fluid communication between the tubing bore and the lower annulus in response to the movement of the piston to its second position.

7. The apparatus of claim 6, further comprising a valve connected in the tubing in the lower annulus for controllably providing fluid communication between the lower annulus and the tubing bore.

8. The apparatus of claim 6, wherein the perforating gun assembly further includes a time delay mechanism which is actuated when the piston moves to its second position and which delays the firing of the gun assembly for a predetermined time interval after actuation of the piston.

9. The apparatus of claim 6, wherein, upon actuation of the piston and the sleeve, the production port allows equalization of pressures between the tubing bore and the lower annulus.

10. The apparatus of claim 9, further comprising sensing means operatively connected to the tubing bore for sensing a pressure drop in the tubing bore when the production port is opened.

11. A well bore perforating apparatus, comprising:

a tubing for insertion into the well bore, forming an annulus in the well bore, the tubing having a longitudinal bore therethrough;

a packer attached to the tubing and intermediate its ends for dividing the annulus into an upper annulus and a lower annulus;

a perforating gun connected to the tubing for location in the lower annulus;

a cylindrical firing head housing connected intermediate the tubing and the gun, the housing having a production port to provide fluid communication between the lower annulus and the tubing bore;

an actuator piston, having upper and lower faces and being slidable longitudinally in the housing, the upper face in fluid communication with the tubing bore, the housing including a equalizing port to provide fluid communication between the lower annulus and the lower face of the piston;

a sleeve which is slidable longitudinally in the housing and movable from a first position, in which its closes the production port in the housing, to a second position, in which it opens the production port, the piston being movable between a first, unactuated position to a second, actuated position in response to a predetermined difference of pressure between the upper and lower faces of the piston, said piston and sleeve being independently slidable in the housing, and means for allowing the pressure in the tubing bore to move the sleeve from its first position to its second position in response to the movement of the piston to its second position.

12. The apparatus of claim 11, further including a sleeve-actuating port in the housing for providing fluid communication between the tubing bore and one end of the sleeve when the piston is in its second position, the sleeve-actuating port being blocked when the piston is in its first position.

13. A well bore perforating apparatus, comprising:

a tubular housing having a radial port and a production port;

a perforating gun connected to the housing; a firing pin in the housing for actuating the gun;

a piston slidable longitudinally in the housing in response to a pressure difference between the interior and exterior of the housing;

a sleeve slidable longitudinally in the housing in response to a pressure in the interior of the housing;

the sleeve being slidable between a first position wherein it blocks the production port to a second position wherein it opens the production port;

the piston being slidable between a first position wherein it blocks the radial port to a second position wherein it causes the firing pin to actuate the gun and wherein the piston opens the radial port;

means for allowing pressure from the interior of the housing to cause the sleeve to slide from its first position to its second position in response to the opening of the radial port.

14. The apparatus of claim 13, further comprising:

a first shear pin for holding the piston in its first position absent a pressure difference between the interior and exterior of the housing; and a second shear pin for holding the sleeve in its first position when the piston is in its first position.

* * * * *